US008834224B2

(12) United States Patent
Ozeki et al.

(10) Patent No.: US 8,834,224 B2
(45) Date of Patent: Sep. 16, 2014

(54) METHOD OF MANUFACTURING METAL SHELL ASSEMBLY FOR SPARK PLUG, METHOD OF MANUFACTURING SPARK PLUG, AND APPARATUS FOR MANUFACTURING METAL SHELL ASSEMBLY FOR SPARK PLUG

(75) Inventors: Atsushi Ozeki, Seto (JP); Keisuke Kure, Inuyama (JP); Takashi Tamada, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 771 days.

(21) Appl. No.: 13/015,861

(22) Filed: Jan. 28, 2011

(65) Prior Publication Data

US 2011/0183573 A1 Jul. 28, 2011

(30) Foreign Application Priority Data

Jan. 28, 2010 (JP) ..... 2010-016520

(51) Int. Cl.
*H01T 21/02* (2006.01)
*B21H 3/04* (2006.01)

(52) U.S. Cl.
CPC ..... *B21H 3/04* (2013.01)
USPC ..... 445/7

(58) Field of Classification Search
CPC ..... B21H 3/04
USPC ..... 445/7; 313/118, 141–144
See application file for complete search history.

(56) References Cited

U.S. PATENT DOCUMENTS

| | | | |
|---|---|---|---|
| 6,111,345 | A | 8/2000 | Shibata et al. |
| 2008/0203882 | A1 | 8/2008 | Kobayashi et al. |
| 2009/0160304 | A1 | 6/2009 | Kameda et al. |

FOREIGN PATENT DOCUMENTS

| | | | | |
|---|---|---|---|---|
| CN | 101465520 | A | 6/2009 | |
| DE | 20 2008 015 598 | U1 | 4/2009 | |
| JP | 11-154582 | A | 6/1999 | |
| JP | 2003-323963 | A | 11/2003 | |
| JP | 2003323963 | A * | 11/2003 | ..... H01T 21/02 |

OTHER PUBLICATIONS

Office Action, dated Sep. 21, 2012, issued by State Intellectual Property Office of the People's Republic of China in counterpart Chinese Patent Application No. 201110033064.8.

* cited by examiner

*Primary Examiner* — Elmito Breval
(74) *Attorney, Agent, or Firm* — Sughrue Mion, PLLC

(57) ABSTRACT

A method of manufacturing a metal shell assembly for a spark plug including a cylindrical metal shell that extends in a direction of a central axis and which has a screw portion formed in an outer peripheral surface thereof, and a bar-shaped ground electrode that extends from a front end portion of the metal shell, the method including: disposing an intermediate assembly, having the ground electrode provided in a metal shell intermediate body, between a plurality of rolling dies having process surfaces facing each other; forming the screw portion by performing a rolling process on the intermediate assembly by the plurality of rolling dies while the intermediate assembly is interposed between the plurality of rolling dies; and positioning the ground electrode in a circumferential direction about a central axis of the intermediate assembly between the disposing and forming steps.

17 Claims, 18 Drawing Sheets

METHOD OF MANUFACTURING METAL SHELL ASSEMBLY FOR SPARK PLUG, METHOD OF MANUFACTURING SPARK PLUG, AND APPARATUS FOR MANUFACTURING METAL SHELL ASSEMBLY FOR SPARK PLUG

BACKGROUND OF THE INVENTION

1. Field of the Invention

The present invention relates to a method and apparatus for manufacturing a spark plug metal shell assembly including a metal shell and a ground electrode of a spark plug for use in a combustion device such as an internal combustion engine, and a method of manufacturing a spark plug.

2. Description of the Related Art

A spark plug is attached to, for example, a combustion device such as an internal combustion engine (engine), and is used to ignite an air-fuel mixture inside a combustion chamber. Generally, the spark plug includes: an insulating body which has a shaft hole; a center electrode which is inserted through the front end side of the shaft hole; a metal shell which is provided in the outer periphery of the insulating body; and a ground electrode which is provided at the front end portion of the metal shell and forms a spark discharge gap between the center electrode and the ground electrode. Further, a screw portion is formed in the outer peripheral surface of the metal shell so as to be threaded into an attachment hole of a combustion device when the spark plug is attached to the combustion device.

However, when the spark plug is attached to a combustion device, for example, the ground electrode is present between a fuel ejecting device and the spark discharge gap, and ejected fuel contacts the rear surface of the ground electrode. For this reason, mixed gas may not be sufficiently supplied to the spark discharge gap due to the presence of the ground electrode, and hence there is a concern that ignition performance may be degraded.

The disposition position of the ground electrode when the spark plug is attached to the combustion device may change depending on the relative positional relationship between the ground electrode and a thread ridge of the screw portion. Accordingly, in order to dispose the ground electrode at a desired position when the spark plug is attached to the combustion device, the thread ridge of the screw portion may be formed at a constant position in the ground electrode. Therefore, a method has been proposed which includes adjusting a position of a ground electrode in the circumferential direction by transporting a metal shell toward a rolling die used to form a screw portion by a rolling process while a ground electrode passes through a passage formed between a pair of guide plates, and forming the screw portion by the rolling die (for example, refer to Patent Document 1 or the like).

[Patent Document 1] Germany Registered Utility Model No. 202008015598

3. Problems to be Solved by the Invention

However, in the above-described method, the metal shell must be transported in a freely rotatable state in the circumferential direction in order to adjust the position of the ground electrode in the circumferential direction. For this reason, the metal shell rotates in the circumferential direction during a time when the ground electrode passes through the guide plates and the metal shell is disposed between the rolling dies. Hence, there is a concern that a positional deviation of the ground electrode may occur. Further, in the above-described method, the metal shell is moved toward the rolling die immediately before the rolling process, but there is a concern that the metal shell may rotate in the circumferential direction even during the movement. That is, in the above-described method, the positioning operation of the ground electrode may not be accurately performed in the circumferential direction, and then the relative positional relationship between the thread ridge of the screw portion and the ground electrode may become irregular.

SUMMARY OF THE INVENTION

The invention has been made in view of the above-described problems, and an object thereof is to provide a method and an apparatus for manufacturing a spark plug metal shell assembly capable of highly accurately forming a thread ridge of a screw portion at a constant position in a ground electrode when forming the screw portion in a metal shell, and a method of manufacturing a spark plug.

The above object has been achieved according to a first illustrative aspect of the present invention by providing a method of manufacturing a metal shell assembly for a spark plug including a cylindrical metal shell that extends in a direction of a central axis and which has a screw portion formed in an outer peripheral surface thereof for threading into an attachment hole of a combustion device, and a bar-shaped ground electrode that extends from a front end portion of the metal shell, the method comprising: disposing an intermediate assembly, having the ground electrode provided in a metal shell intermediate body to be used as the metal shell, between a plurality of rolling dies having process surfaces facing each other; forming the screw portion by performing a rolling process on the intermediate assembly by the plurality of rolling dies while the intermediate assembly is interposed between the plurality of rolling dies; and positioning the ground electrode in a circumferential direction about a central axis of the intermediate assembly between the disposing and forming steps.

According to the first illustrative aspect, the positioning operation of the ground electrode is performed in the circumferential direction with respect to the intermediate assembly after the intermediate assembly is disposed between the rolling dies, and then the screw portion is formed by the rolling dies. That is, the positioning operation of the ground electrode is performed before the rolling process, and the screw portion is formed while the position of the ground electrode is highly accurately adjusted in the circumferential direction. For this reason, the thread ridge of the screw portion may be highly accurately formed at a constant position in the ground electrode.

According to a second illustrative aspect of the present invention, in addition to the first aspect, the intermediate assembly includes a seat portion that protrudes outward in a radial direction and has a front end side surface directly or indirectly contacting the combustion device when the screw portion is threaded into the attachment hole of the combustion device, and wherein said positioning the ground electrode (i.e., the positioning step) is performed while the front end side surface of the seat portion is pressed against the plurality of rolling dies.

The disposition position of the ground electrode when the spark plug is attached to the combustion device is determined depending on the thread-insertion length of the screw portion in addition to the position of the thread ridge of the screw portion with respect to the ground electrode. Here, when the spark plug is attached to the combustion device, the front end side surface of the seat portion provided in the metal shell directly or indirectly contacts the combustion device. That is, the thread-insertion length of the screw portion is determined depending on the relative formation position of the seat portion in the metal shell.

According to the second illustrative aspect in consideration of this point, the positioning operation of the ground electrode is performed in the circumferential direction while the front end side surface of the seat portion of the intermediate assembly is pressed against the rolling dies. Accordingly, the positioning operation of the ground electrode may be very easily performed in consideration of the thread-insertion length of the screw portion. As a result, the thread ridge of the screw portion may be more accurately formed at a constant position in the ground electrode.

In addition, since the positioning operation of the ground electrode is performed while the seat portion is pressed against the rolling die, a problem in which the ground electrode moves too much during the positioning operation does not easily arise. Accordingly, the positioning operation of the ground electrode may be more accurately performed in the circumferential direction, and the thread ridge of the screw portion may be more reliably formed at a constant position.

Further, in order to more reliably prevent the ground electrode from moving too much during the positioning operation, a pressure of the seat portion acting on the rolling die is desirably set to be equal to or more than 5 N, and the pressure is more desirably set to be equal to or more than 10 N. On the other hand, when the pressure of the seat portion with respect to the rolling die is set to be excessively large, it is difficult to rotate the intermediate assembly, and hence there is a concern that the positioning operation of the ground electrode may not be smoothly performed. Accordingly, the pressure is desirably equal to or less than 100 N, and the pressure is more desirably equal to or less than 50 N.

According to a third illustrative aspect of the present invention, in addition to the second aspect, in positioning the ground electrode, at least a part of a surface located at a halfway point of an inner peripheral side of the front end side surface of the seat portion contacts the plurality of rolling dies.

According to the third aspect, the front end side surface of the seat portion may be pressed against the rolling die in a more reliable state. For this reason, the effect of the second aspect may be more reliably obtained.

According to a fourth illustrative aspect of the present invention, in addition to the first aspect, the intermediate assembly includes a seat portion that protrudes outward in a radial direction and has a front end side surface directly or indirectly contacting the combustion device when the screw portion is threaded into the attachment hole of the combustion device, and wherein said positioning the ground electrode is performed while the front end side surface of the seat portion is pressed against a pressing jig disposed between the seat portion and the plurality of rolling dies.

According to the fourth aspect, the same effect as that of the second aspect may basically be obtained.

Further, the relative positional relationship between the ground electrode and the formed screw portion may be variously changed by changing a thickness (height) of the pressing jig and a distance between the seat portion and each of the rolling dies. That is, the relative positional relationship between the formed screw portion and the ground electrode may be easily adjusted simply by providing the pressing jig without changing the target disposition position of the ground electrode in the positioning step or the configuration of the rolling dies. Accordingly, since it is not necessary to change the target disposition position of the ground electrode in the positioning step in accordance with the size of each plug when spark plug metal shell assemblies having different sizes are manufactured, an increase in manufacturing cost may be suppressed or productivity may be improved.

Further, as in the case where the seat portion is pressed against the rolling die, a pressure of the seat portion acting on the pressing jig is desirably set to be equal to or more than 5 N and equal to or less than 100 N, and the pressure is more desirably set to be equal to or more than 10 N and equal to or less than 50 N.

According to a fifth illustrative aspect of the present invention, in addition to the fourth aspect, in positioning the ground electrode, at least a part of a surface located at a halfway point of an inner peripheral side of the front end side surface of the seat portion contacts the pressing jig.

According to the fifth aspect, since the front end side surface of the seat portion may be more reliably pressed against the pressing jig, the effect of the fourth aspect may be more reliably obtained.

According to a sixth illustrative aspect of the present invention, in addition to the fourth aspect or the fifth aspect, the pressing jig is removed between the positioning and forming steps, and in forming the screw portion, the rolling process is performed while the front end side surface of the seat portion is spaced from the rolling dies.

An exemplary rolling die includes a type in which a process target escapes from (returns to) the rolling die during a machining work or a type in which a process target moves toward the rolling die.

According to the sixth aspect, the pressing jig is removed after the positioning step, and the screw portion is formed while a gap is provided between the seat portion and the rolling die. Accordingly, not only a rolling die in which the process target escapes from (returns to) the rolling die, but also a rolling die in which the process target moves toward the rolling die may be used. For this reason, productivity may be further improved.

According to a seventh illustrative aspect of the present invention, in addition to the first aspect, said positioning the ground electrode is performed while the front end surface of the intermediate assembly is pressed against a pressing jig disposed between the plurality of rolling dies.

According to the seventh aspect, the positioning operation of the ground electrode is performed while the front end surface of the intermediate assembly is pressed against the pressing jig. For this reason, a problem in which the ground electrode moves too much during the positioning operation does not easily arise, and hence the positioning operation of the ground electrode may be more accurately performed in the circumferential direction. As a result, the thread ridge of the screw portion may be highly accurately formed at a constant position in the ground electrode.

According to an eighth illustrative aspect of the present invention, in addition to anyone of the first aspect to the seventh aspect, in positioning the ground electrode, a positioning jig is used which is movable in the direction perpendicular to the central axis and has a tapered surface inclined with respect to the movement direction and parallel to the direction of the central axis, and said positioning the ground electrode is performed by moving the positioning jig while the ground electrode contacts the tapered surface.

According to the eighth aspect, the tapered surface contacts the tapered surface of the ground electrode, and the positioning jig moves by a predetermined distance, so that the position of the ground electrode in the circumferential direction may be appropriately set to a constant position at all times. The positioning jig may be adapted to be movable in a reciprocating manner, and a comparatively simple mechanism may be used as a movement or driving means of the positioning jig. This prevents the manufacturing facility from becoming complicated.

Further, it is more meaningful to adopt the second aspect or the like when using the eighth aspect. That is, when the intermediate assembly is freely rotatable without any resistance, there is a concern that the ground electrode may move further immediately after the positioning jig is stopped. The rotation of the intermediate assembly may be regulated to a certain degree by adopting the second aspect or the like, and the movement of the ground electrode may be prevented as much as possible even after the positioning jig is stopped. As a result, the positioning operation of the ground electrode may be more accurately performed.

According to a ninth aspect of the present invention, in addition to the eighth aspect, in positioning the ground electrode, at least first and second positioning jigs are used in positioning the ground electrode such that the second positioning jig is movable in a direction perpendicular to the movement direction of the first positioning jig and the central axis, and wherein said positioning the ground electrode is performed by moving the first positioning jig while the ground electrode contacts the tapered surface of the first positioning jig and moving the second positioning jig while the ground electrode contacts the tapered surface of the second positioning jig.

As in the ninth aspect, the positioning operation of the ground electrode may be performed by using plural positioning jigs. In this case, the ground electrode may be more accurately disposed at a predetermined position.

According to a tenth aspect of the present invention, in addition to the eighth aspect or the ninth aspect, the positioning jig includes a first side surface that is located at the intermediate assembly side in the positioning of the ground electrode and a second side surface that is located at an opposing side to the first side surface, and the tapered surface is connected to both the first side surface and the second side surface by curved surface portions that are formed in a curved surface shape and protrude outward.

Generally, the ground electrode is formed so as to be bonded to the front end surface of the metal shell intermediate body, but the ground electrode may be bonded to the front end surface of the metal shell intermediate body in a slightly inclined state due to various factors. Here, when the tapered surface of the positioning jig contacts the ground electrode, only the angular portion located at the edge portion of the tapered surface may contact the ground electrode. In this case, flaws are generated in the ground electrode with movement of the positioning jig, and hence there is a concern that the yield rate may be degraded.

According to the tenth aspect, the curved surface portions are formed such that the tapered surface is connected to the first side surface and the tapered surface is connected to the second side surface by curved portions which protrude outward, and an angular portion is not formed in the edge portion of the tapered surface. Accordingly, damage to the ground electrode with the movement of the positioning jig may be more reliably prevented, and hence the yield rate may be improved.

According to an eleventh illustrative aspect of the present invention, in addition to the eighth aspect to the tenth aspect, the positioning jig includes a portion that is formed in a curved surface shape protruding outward or a tapered shape inclining from a movement front end surface toward the tapered surface when the positioning jig is moved toward the ground electrode.

According to the eleventh aspect, the positioning jig includes a portion that is formed in a curved surface shape protruding outward or a tapered shape between the tapered surface and a movement front end surface located at the front end when the positioning jig is moved toward the ground electrode. Accordingly, in the disposition step, even when the ground electrode is disposed on the movement path of the positioning jig, a problem in which the ground electrode collides with the front end surface of the positioning jig does not easily arise. For this reason, damage or deformation of the ground electrode due to the positioning step may be more reliably prevented, and hence the yield rate may be further improved.

According to a twelfth illustrative aspect of the present invention, in addition to the eight aspect to the eleventh aspect, in positioning the ground electrode, the positioning jig contacts a portion between a portion spaced from the front end side of the ground electrode toward the base end side thereof by 1 mm and a portion spaced from the base end side thereof toward the front end side thereof by 1 mm.

Although the ground electrode may be formed by shear-cutting a direct bar-shaped metal material, a wide width portion (a so-called "burr") may be formed at the end portion of the ground electrode during the cutting operation so as to be slightly widened in the width direction. Generally, the ground electrode is bonded to the front end surface of the metal shell intermediate body by resistance welding, but a fusion portion (so-called "sagging") may be formed in the outer periphery of the bonding portion of the ground electrode in accordance with the resistance welding. Here, when the positioning operation of the ground electrode is performed while the positioning jig contacts the wide width portion or the fusion portion, there is a concern that the positioning accuracy may be degraded as much as the wide width portion or the fusion portion.

According to the twelfth aspect, in the positioning step, the positioning jig contacts a portion between a portion spaced from the front end side of the ground electrode toward the base end side thereof by 1 mm and a portion spaced from the base end side thereof toward the front end side thereof by 1 mm. That is, the wide width portion or the fusion portion is formed at a portion which is spaced from the end of the ground electrode by 1 mm and in which the wide width portion or the fusion portion may be easily formed, and the positioning jig is adapted to contact a portion except for the portion having the wide width portion or the fusion portion in the ground electrode. For this reason, even when the wide width portion or the fusion portion is formed, the positioning operation of the ground electrode may be more accurately performed.

According to a thirteenth illustrative aspect of the present invention, in addition to the eighth aspect to the twelfth aspect, in positioning the ground electrode, at least a part of the tapered surface of the positioning jig contacts a portion between the center portion of the ground electrode and the base end portion thereof in the longitudinal direction.

According to the thirteenth aspect, the positioning jig is adapted to contact the base end side (the root side) of the ground electrode. Accordingly, deformation of the ground electrode may be more reliably prevented during the positioning operation.

According to a fourteenth illustrative aspect, in addition to anyone of the first aspect to the seventh aspect, a positioning jig rotatable about the central axis is used in positioning the ground electrode, and said positioning of the ground electrode is performed by rotating the positioning jig while the ground electrode contacts the positioning jig.

As in the fourteenth aspect, the positioning operation of the ground electrode may be performed by using the rotatable positioning jig. In this case, the ground electrode may be prevented from being moved due to friction with respect to the positioning jig, and flaws of the ground electrode may be more reliably prevented.

According to a fifteenth illustrative aspect of the present invention, in addition to the fourteenth aspect, the positioning jig is adapted to grip the ground electrode, and said positioning the ground electrode is performed while the ground electrode is gripped by the positioning jig.

As in the fifteenth aspect, the ground electrode is gripped by the positioning jig, and then the positioning operation of the ground electrode may be performed. In this case, the same effect as that of the fourteenth aspect may be obtained, and the positioning operation of the ground electrode may be more accurately performed.

A sixteenth illustrative aspect of the present invention provides a method of manufacturing a spark plug, the method comprising: assembling an insulator having a center electrode and a terminal electrode assembled thereto to the metal shell assembly manufactured by the method according to the above first aspect from the base end side thereof; and allowing the front end portion of the ground electrode to face the center electrode.

In the sixteenth aspect, the technical concept of the first aspect and the like may be applied to the method of manufacturing the spark plug. In this case, in the manufactured spark plug, the screw portion and the ground electrode may have a preferred relative positional relationship. Accordingly, when the manufactured spark plug is assembled to the combustion device, a problem encountered when the ground electrode is present between the fuel ejecting device and the spark discharge gap formed between the center electrode and the ground electrode may be more reliably prevented. Further, degradation of ignition performance may also be more reliably prevented.

A seventeenth illustrative aspect of the present invention provides an apparatus for manufacturing a metal shell assembly for a metal shell including a cylindrical metal shell that extends in a direction of a central axis and a screw portion formed in the outer peripheral surface thereof for threading into an attachment hole of a combustion device, and a bar-shaped ground electrode that extends from a front end portion of the metal shell, the apparatus comprising: a disposition unit for disposing an intermediate assembly, having the ground electrode provided in a metal shell intermediate body for use as the metal shell, between a plurality of rolling dies having process surfaces facing each other; and a positioning unit for positioning the ground electrode in a circumferential direction about a central axis of the intermediate assembly disposed between the plurality of rolling dies before a rolling process of the screw portion using the rolling dies.

According to the seventeenth aspect, the same effect as that of the above first aspect may basically be obtained. That is, the screw portion may be highly accurately formed at a constant position in the ground electrode by performing a positioning operation of the ground electrode using the positioning unit and a rolling process using the rolling dies while the intermediate assembly is disposed between the rolling dies by the disposition unit.

BRIEF DESCRIPTION OF THE DRAWINGS

Illustrative aspects of the invention will be described in detail with reference to the following figures wherein:

FIG. 3 is a schematic perspective view illustrating a configuration of a rolling die and the like;

FIG. 4A is an enlarged plan view illustrating the rolling die and the like, and FIG. 4B is an enlarged front view illustrating the rolling die and the like;

FIG. 5A is a schematic enlarged front view illustrating the rolling die and the like, and FIG. 5B is an enlarged front view illustrating the rolling die and the like;

FIG. 8B is an enlarged front view illustrating the positioning jig and the like after the positioning operation;

FIG. 12A is an enlarged plan view illustrating the pressing jig and the like, and FIG. 12B is an enlarged cross-sectional view illustrating the pressing jig and the like;

FIG. 13A is an enlarged plan view illustrating the positioning jig and the like before the positioning operation, and FIG. 13B is an enlarged front view illustrating the positioning jig and the like after the positioning operation;

FIG. 17A is an enlarged plan view illustrating the positioning jig and the like, and FIG. 17B is an enlarged side view illustrating the positioning jig and the like;

FIG. 18A is an enlarged plan view illustrating the positioning jig and the like, and FIG. 18B is an enlarged front view illustrating the positioning jig and the like.

DESCRIPTION OF THE REFERENCE NUMERALS

Figure 1:
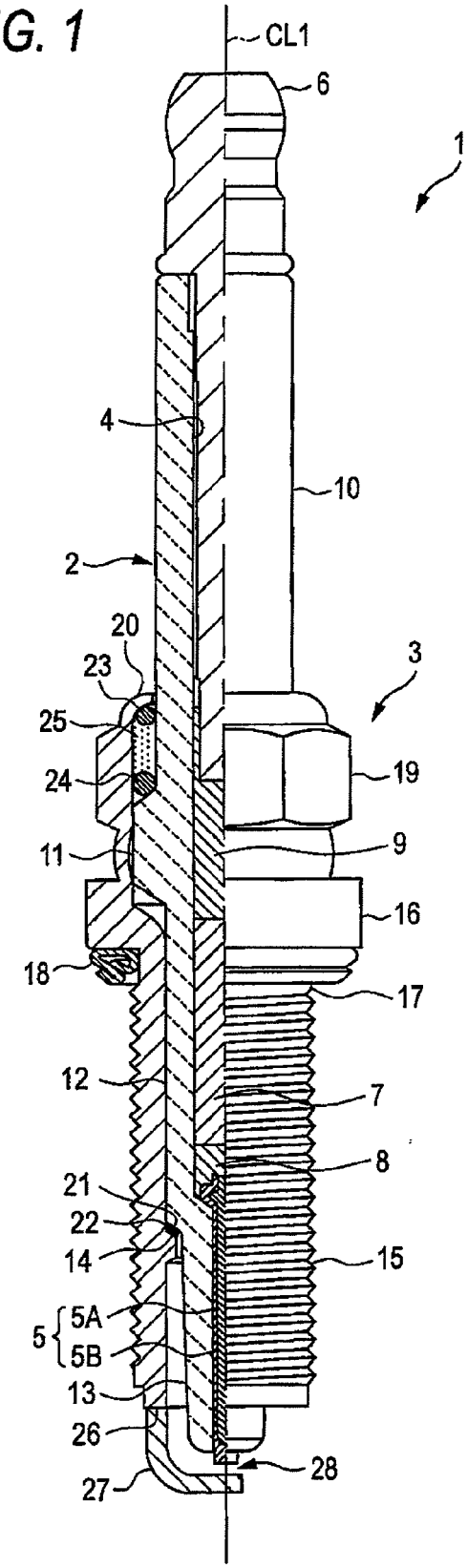
FIG. 1 is a partially cutaway front view illustrating a configuration of a spark plug.

Various reference numerals used to identify structural features in the drawings include the following.

1: Spark Plug
2: Insulator (Insulating Body)
3: Metal Shell
5: Center Electrode
6: Terminal Electrode
15: Screw Portion
16, 33: Seat Portion
27: Ground Electrode
30: Metal Shell Intermediate Body
31: Intermediate Assembly
35: Spark Plug Metal Shell Assembly
CL1: Central Axis
D1, D2: Rolling Die
JG, JG1, JG2, JH, JI, JJ, JK: Positioning JIG (Positioning Unit)
HA: Disposition Unit
TA, TA1, TA2: Tapered Surface
PJ1, PJ2, PJ3: Pressing JIG
R1, R2, R3: Curved Surface Portion
SI1: First Side Surface
SI2: Second Side Surface

DETAILED DESCRIPTION OF THE PREFERRED EMBODIMENTS

Hereinafter, an embodiment of the invention will be described in greater detail by reference to the drawings. However, the present invention should not be construed as being limited thereto.

FIG. 1 is a partially cutaway front view illustrating a spark plug 1. Further, in FIG. 1, the direction of the central axis CL1 of the spark plug 1 is described as the up and down direction of the drawing, the lower side is described as the front end side of the spark plug 1, and the upper side is described as the rear end side thereof.

The spark plug 1 includes an insulator 2 which is a cylindrical insulator, a cylindrical metal shell 3 which holds the insulator, and the like.

As widely known, the insulator 2 is formed by baking alumina or the like at a high temperature, and includes: a rear end side body portion 10 which is formed at the rear end side of the external shape; a large diameter portion 11 which is disposed at the front end side in relation to the rear end side body portion 10 and protrudes outward in the radial direction; a middle body portion 12 which is disposed at the front end side in relation to the large diameter portion 11 and has a diameter smaller than that of the large diameter portion 11; and a long leg portion 13 which is disposed at the front end side in relation to the middle body portion 12 and has a diameter smaller than that of the middle body portion 12. Further, the large diameter portion 11, the middle body portion 12, and most of the long leg portion 13 of the insulator 2 are accommodated inside the metal shell 3. Then, the connection portion between the middle body portion 12 and the long leg portion 13 is provided with a tapered step portion 14, and the insulator 2 is locked to the metal shell 3 at the step portion 14.

A shaft hole 4 penetrates the insulator 2 along the central axis CL1, and a center electrode 5 is inserted and fixed to the front end side of the shaft hole 4. The center electrode 5 includes an inner layer 5A which is formed of copper or a copper alloy and an outer layer 5B which is formed of an Ni alloy mainly containing nickel (Ni). The center electrode 5 is formed in a bar shape (column shape) as a whole, and the front end portion thereof protrudes from the front end of the insulator 2.

Further, a terminal electrode 6 is inserted and fixed to the rear end side of the shaft hole 4 so as to protrude from the rear end of the insulator 2.

A columnar resistor 7 is disposed between the terminal electrode 6 and the center electrode 5 of the shaft hole 4. Both end portions of the resistor 7 are respectively and electrically connected to the center electrode 5 and the terminal electrode 6 through conductive glass seal layers 8 and 9.

Further, the metal shell 3 is formed of metal such as low-carbon steel so as to have a cylindrical shape, and its outer peripheral surface is provided with a screw portion (male screw portion) 15 that is used to attach the spark plug 1 to a combustion device such as an internal combustion engine or a fuel battery reformer. Further, the rear end side of a screw portion 15 is provided with a seat portion 16 formed to protrude toward the outer peripheral side of the spark plug, and an annular gasket 18 is fitted into a screw neck portion 17 of the rear end of the screw portion 15. The rear end side of the metal shell 3 is provided with a tool engagement portion 19 that has a hexagonal cross-section and is used to allow the metal shell 3 to engage a tool such as a wrench when the metal shell is attached to the combustion device, and a crimping portion 20 that is used to hold the insulator 2 at the rear end portion thereof. Further, in the embodiment, the metal shell 3 is formed to have a reduced diameter in order to realize a decrease in the diameter of the spark plug 1. For this reason, the screw diameter of the screw portion 15 is set to a comparatively small diameter (for example, M12 or less).

Further, the inner peripheral surface of the metal shell 3 is provided with a tapered step portion 21 that is used to lock the insulator 2. Then, the insulator 2 is inserted from the rear end side of the metal shell 3 toward the front end side thereof, and is fixed by crimping an open portion of the rear end side of the metal shell 3 toward the inside of the radial direction, that is, forming the crimping portion 20 while the step portion 14 is locked to the step portion 21 of the metal shell 3. Further, an annular plate packing 22 is interposed between the step portions 14 and 21 of both the insulator 2 and the metal shell 3. Accordingly, air-tightness inside a combustion chamber is maintained, and a fuel gas enclosed between a gap between the inner peripheral surface of the metal shell 3 and the long leg portion 13 of the insulator 2 exposed to the inside of the combustion chamber does not leak to the outside.

In order to more completely maintain the hermetic state by the crimping, annular members 23 and 24 are interposed between the metal shell 3 and the insulator 2 at the rear end side of the metal shell 3, and a gap between the annular members 23 and 24 is filled with powder of talc (talcum) 25. That is, the metal shell 3 holds the insulator 2 through the plate packing 22, the annular members 23 and 24, and the talc 25.

Further, a ground electrode 27 is bonded to a front end surface 26 of the metal shell 3 so as to be bent back at its substantially middle portion and to allow the side surface of the front end side thereof to face the front end portion of the center electrode 5. The ground electrode 27 is formed to have a rectangular cross-section, and is formed of an Ni alloy containing Ni as a main component. Further, the area of the front end surface 26 of the metal shell 3 becomes comparatively smaller in accordance with a reduction in the diameter of the metal shell 3. For this reason, the ground electrode 27 bonded to the front end surface 26 is formed in an elongated thin shape, and to have a comparatively narrow width (for example, 3.0 mm or less) and a comparatively thin thickness (for example, 2.0 mm or less).

Further, a spark discharge gap 28 is formed as a gap between the front end portion of the center electrode 5 and the front end portion of the ground electrode 27. Then, spark discharge is performed in the spark discharge gap 28 in the direction substantially along the central axis CL1.

Next, a method of manufacturing the spark plug 1 having the above-described configuration will be described.

First, the insulator 2 is formed by molding. For example, base stock granulated particles for molding are formed by using raw powder containing alumina as a main component and a binder or the like, and rubber press-molding is performed by using the base stock granulated particles, thereby obtaining a cylindrical molded body. Then, grinding is performed on the obtained molded body to have a certain external shape, and the resultant object is baked in a baking furnace, thereby obtaining the insulator 2.

Further, the center electrode 5 is formed separately from the insulator 2. That is, the center electrode 5 is manufactured by forging an Ni alloy having a copper alloy disposed at the center portion thereof to improve heat radiation performance.

Then, the insulator 2, the center electrode 5, the resistor 7, and the terminal electrode 6 obtained as described above are sealed and fixed to each other by the glass seal layers 8 and 9. Generally, the glass seal layers 8 and 9 may be formed in such a manner that a metal powder is mixed with borosilicate glass, the resultant object is injected into the shaft hole 4 of the insulator 2 with the resistor 7 interposed therebetween, and the injected object is heated to be baked and hardened in a baking furnace while suppressing the rear side using the terminal electrode 6. Further, at this time, a lustering agent layer may be simultaneously formed on the surface of the rear end side body portion 10 of the insulator 2, or the lustering agent layer may be formed thereon in advance.

Figure 2:
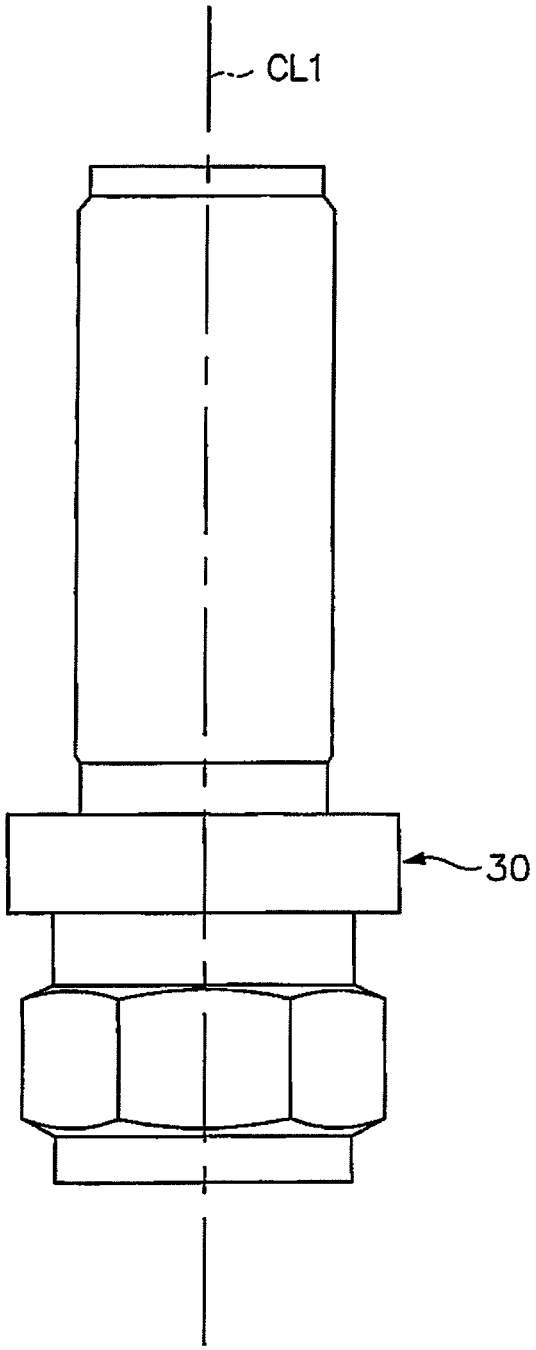
FIG. 2 is a front view illustrating a configuration of a metal shell intermediate body.

Next, the metal shell 3 is formed. First, an outline and a perforation hole are formed by cold forging or the like on a columnar metal material (for example, a stainless material or an iron material such as S17C or S25C). Subsequently, cutting is performed on the resultant object so as to trim the external shape thereof, thereby obtaining a metal shell intermediate body 30 as shown in FIG. 2.

Subsequently, the direct bar-shaped ground electrode 27 formed of an Ni alloy is bonded to the front end surface of the metal shell intermediate body 30 by resistance welding, thereby obtaining an intermediate assembly 31 (refer to FIG. 4 and the like). Since a so-called "sagging" is generated during the welding, the "sagging" is removed therefrom, and a screw portion 15 is formed in a predetermined portion of the intermediate assembly 31.

The process of forming the screw portion 15 will be described in detail, and the forming process includes: a disposition step, a positioning step, and a rolling step.

Figure 3:
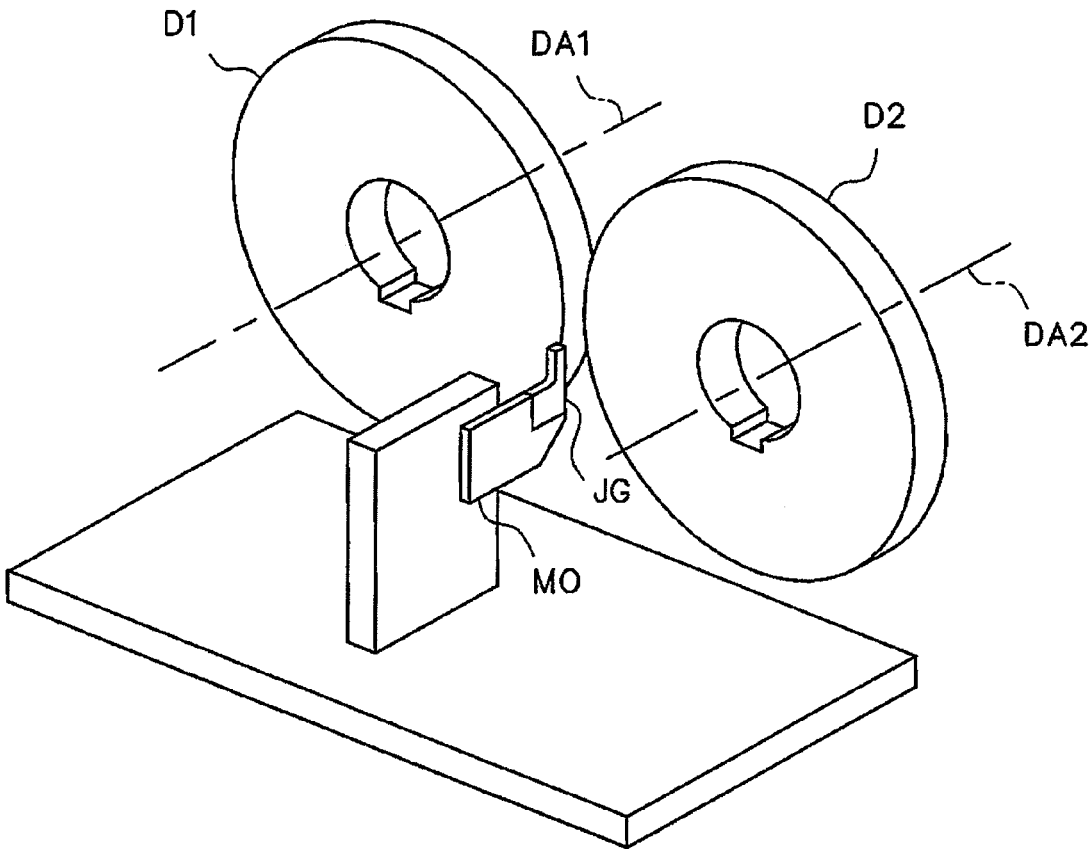

The disposition step is a step that disposes the intermediate assembly 31 between plural (in the embodiment, a pair of) rolling dies D1 and D2 by using a disposition unit HA (refer to FIG. 4 and the like) shown in FIG. 3. Further, each of the rolling dies D1 and D2 is formed in a disc shape, and the outer peripheral surface thereof is provided with a screw rolling surface (process surface) that is not shown in the drawings. The rolling dies D1 and D2 are disposed so that their process surfaces face each other, and are supported by shafts DA1 and DA2 so as to be respectively rotatable about the shafts (further, in FIG. 3, a support means or a rotation means of the rolling dies D1 and D2 or the disposition unit HA and the like are not shown in the drawings). In addition, both rolling dies D1 and D2 are disposed so that the process surfaces of both rolling dies D1 and D2 are comparatively close to each other.

Figure 4A:
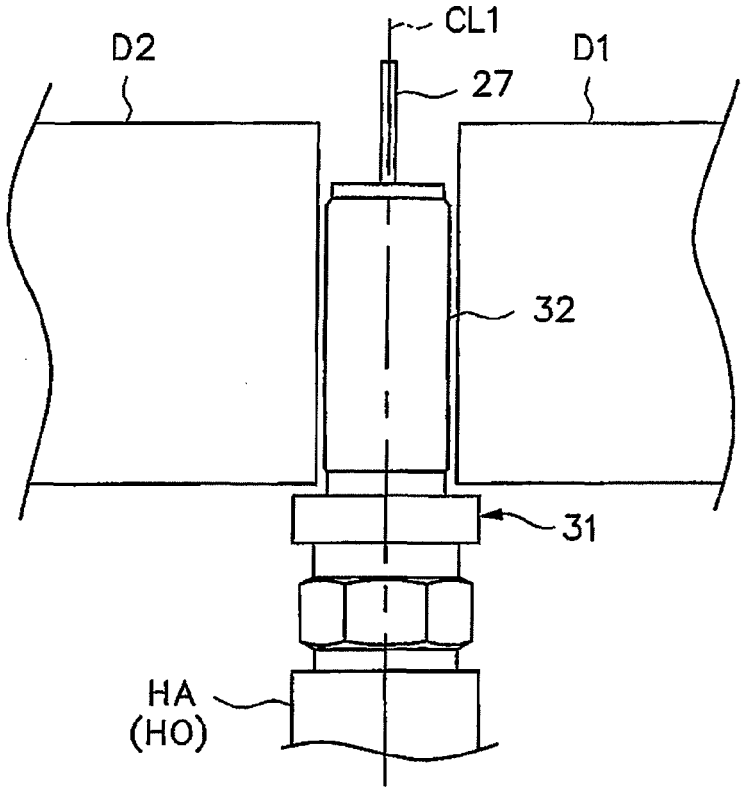
FIG. 4A and FIG. 4B are diagrams illustrating a disposition position of an intermediate assembly in a disposition step, where
Figure 4B:
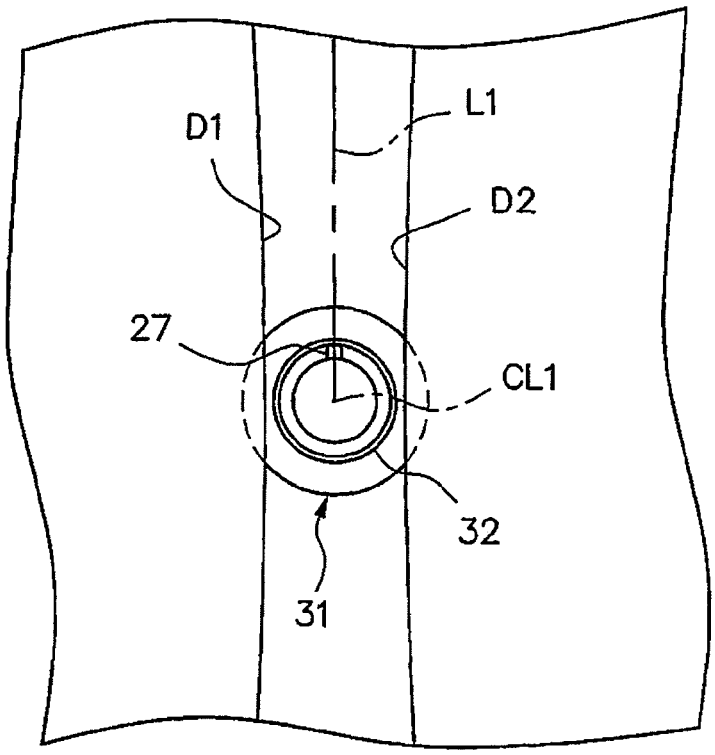

Returning to the manufacturing method, in the disposition step, as shown in FIGS. 4A and 4B, a cylindrical processed portion 32 which is a portion to be provided with the screw portion 15 in the intermediate assembly 31 is disposed between the rolling dies D1 and D2 while the rear end portion of the intermediate assembly 31 is held by the holding means HO provided in the disposition unit HA. Further, before the disposition step, a position in the circumferential direction of the ground electrode 27 is adjusted to a certain degree by a predetermined positioning unit (for example, a guide plate or the like described in Patent Document 1). For this reason, the intermediate assembly 31 is disposed between the rolling dies D1 and D2 while the position in the circumferential direction of the ground electrode 27 is adjusted to a certain degree (in the embodiment, the ground electrode 27 is adjusted to be located within the range of 15° in the left and right direction about the line L1 extending upward in the direction perpendicular to the central axis CL1. Further, the disposition unit HA is adapted to be movable so as to be close to or away from the rolling dies D1 and D2, and the intermediate assembly 31 is held so as to be rotatable about the central axis CL1 serving as a rotation axis by the holding means HO.

Figure 5A:
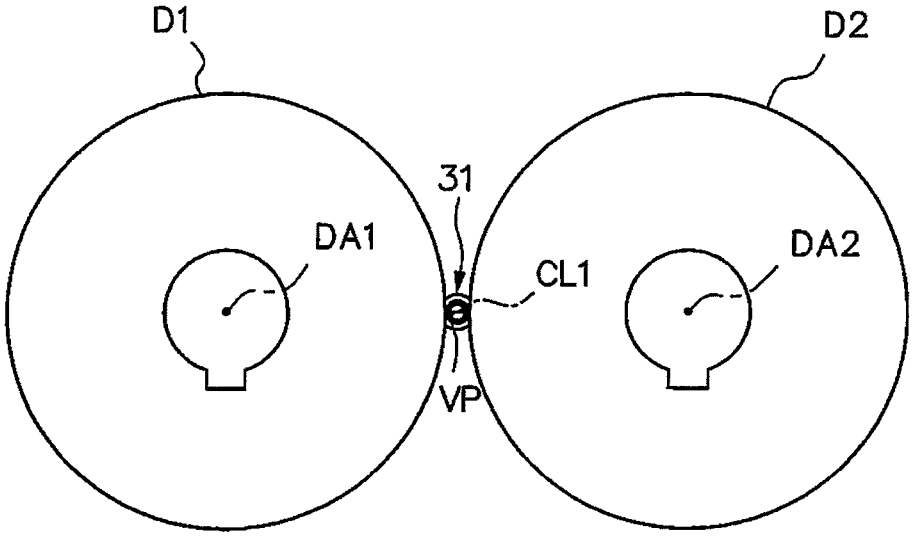
FIG. 5A and FIG. 5B are diagrams illustrating a virtual plane used to dispose a processed portion of the intermediate assembly thereon, where
Figure 5B:
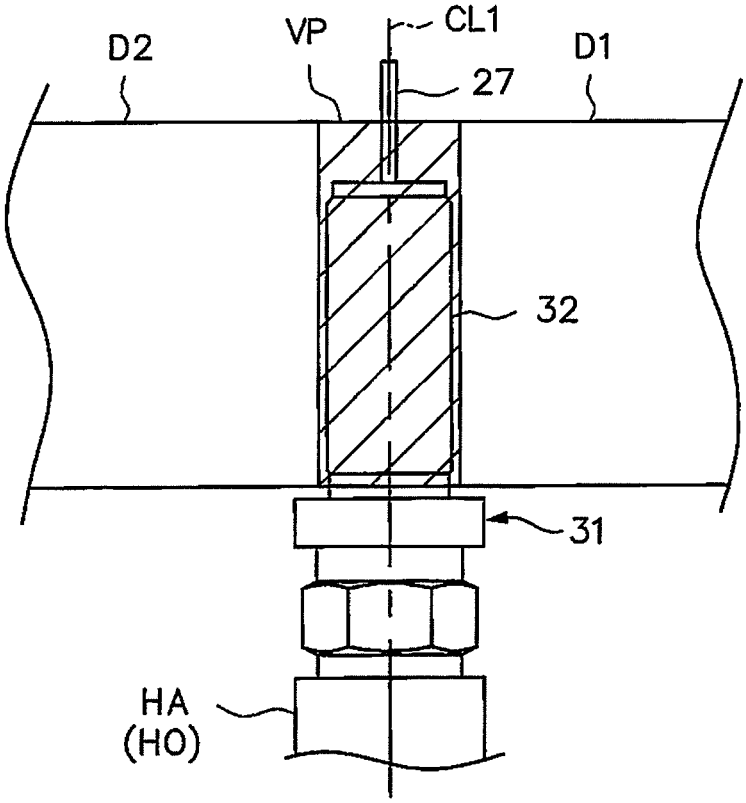

In the embodiment, as shown in FIGS. 5A and 5B, the processed portion 32 of the intermediate assembly 31 is disposed between the rolling dies D1 and D2 so that the central axis CL1 overlaps with the virtual plane VP (depicted by the slanted line in FIG. 5B) that serves as a plane connecting the shafts DA1 and DA2 as the rotation shafts of the rolling dies D1 and D2, and is located between the process surfaces of the rolling dies D1 and D2 so as to be positioned between both side surfaces of the rolling dies D1 and D2. However, "to dispose the intermediate assembly 31 between the rolling dies D1 and D2" is not limited to such a disposition, but at least a part of the processed portion 32 may be located so as to be connected to the virtual plane VL.

Further, as described above, since the process surfaces of both rolling dies D1 and D2 are comparatively close to each other, a gap between the processed portion 32 and each of the rolling dies D1 and D2 while the processed portion 32 is disposed between the rolling dies D1 and D2 is set to be a predetermined value or less (for example, 1.0 mm or less, and desirably 0.5 mm or less).

Figure 6:
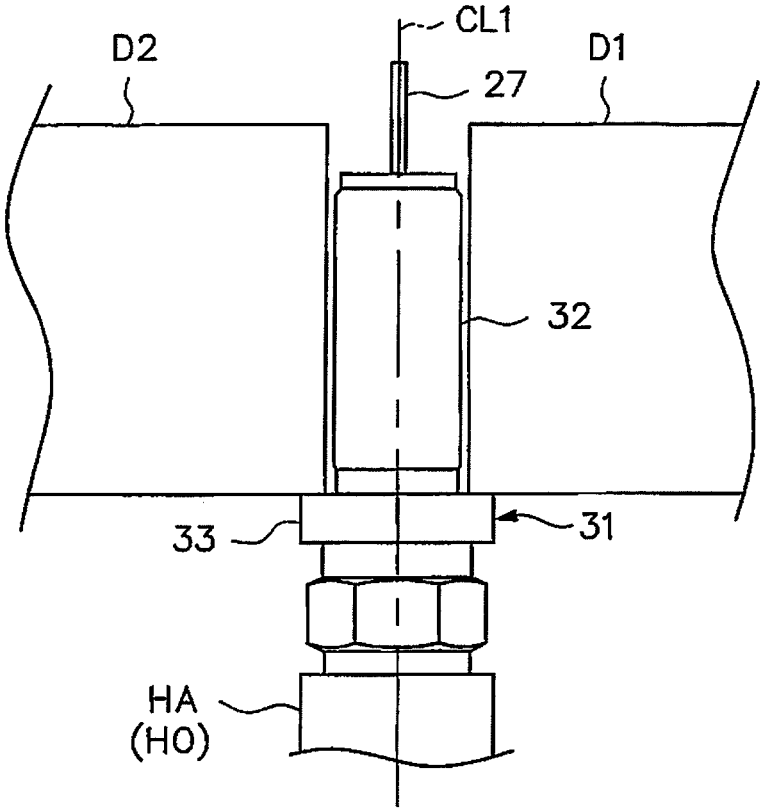
FIG. 6 is an enlarged plan view illustrating the intermediate assembly and the like in a positioning step.

After the intermediate assembly 31 is disposed between the rolling dies D1 and D2, the disposition unit HA moves close to the rolling dies D1 and D2 as shown in FIG. 6, so that the front end side surface of the seat portion 33 (corresponding to the seat portion 16) of the intermediate assembly 31 is pressed against the side surfaces of the rolling dies D1 and D2. At this time, since the gap between each of the process surfaces of the rolling dies D1 and D2 and the processed portion 32 is comparatively small, at least a part of a portion located at a half of the inner peripheral side in the front end side surface of the seat portion 33 comes into contact with the side surfaces of the rolling dies D1 and D2. Further, a pressure of the seat portion 33 acting on the rolling dies D1 and D2 is set to be equal to or more than 5 N and equal to or less than 100 N (more desirably, a range equal to or more than 10 N and equal to or less than 50 N).

Figure 7:
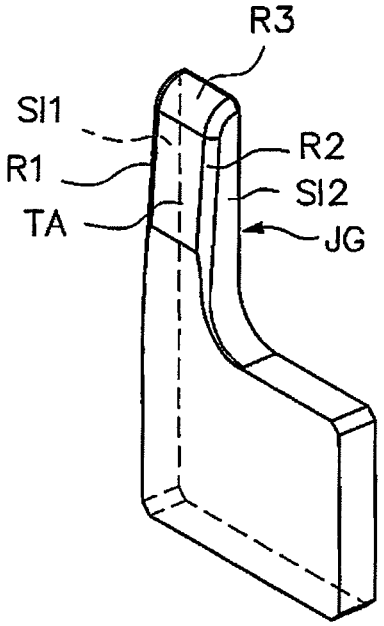
FIG. 7 is a partially enlarged perspective view illustrating a positioning jig.

Subsequently, in the positioning step, the ground electrode 27 is positioned with respect to the intermediate assembly 31 in the circumferential direction about the central axis CL1. The positioning operation of the ground electrode 27 is performed by the positioning jig JG as a positioning unit shown in FIG. 7.

The positioning jig JG is attached to a movement means MO (refer to FIG. 3) that is adapted to be movable in the direction (in the embodiment, the perpendicular direction) perpendicular to the central axis CL1, so that the positioning jig is adapted to be movable in a reciprocating manner in the direction perpendicular to the central axis CL1. Further, the positioning jig JG has a tapered surface TA that is inclined with respect to the movement direction and parallel to the central axis CL1, and the inclination angle of the tapered surface TA with respect to the movement direction is set to be comparatively small (for example, 30° or less). The positioning jig JG has a first side surface SI1 that is located at the side of the intermediate assembly 31 (the rolling dies D1 and D2) and a second side surface SI2 that is located at the rear surface of the first side surface SI1. Then, curved surface portions R1 and R2 are respectively formed between the tapered surface TA and the first side surface SI1 and between the tapered surface TA and the second side surface SI2 so as to protrude outward. Furthermore, in the positioning jig JG, a curved surface portion R3 is formed in a convex curved surface shape that protrudes outward from the leading end portion of the movement front end surface located at the front end in the movement direction toward the tapered surface TA when the positioning jig moves toward the ground electrode 27. In the positioning jig JG, at least the tapered surface TA and the surfaces of the curved surface portions R1, R2 and R3 are made smooth.

Figure 8A:
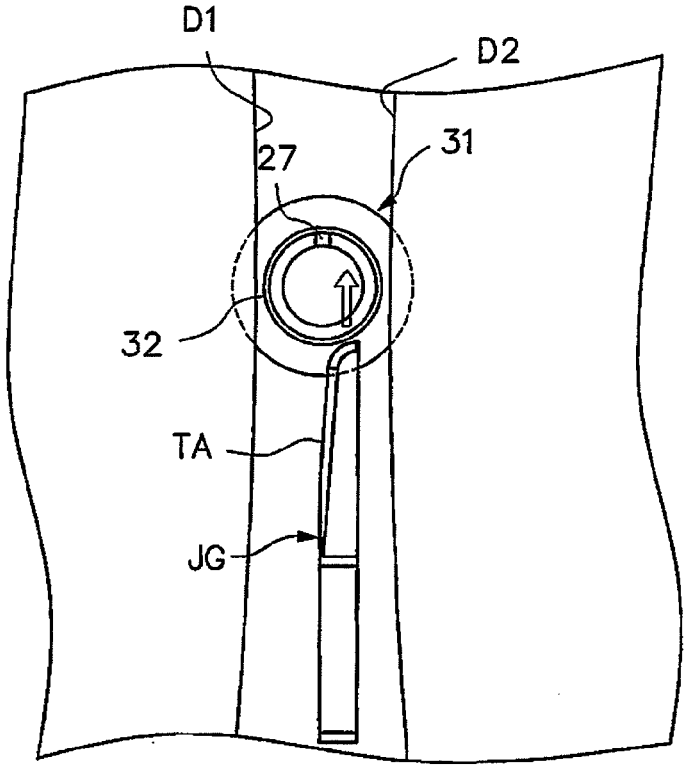
FIG. 8A and FIG. 8B are diagrams illustrating an operation of the positioning jig in the positioning step, where FIG. 8 A is an enlarged front view illustrating the positioning jig and the like before a positioning operation.
Figure 8B:
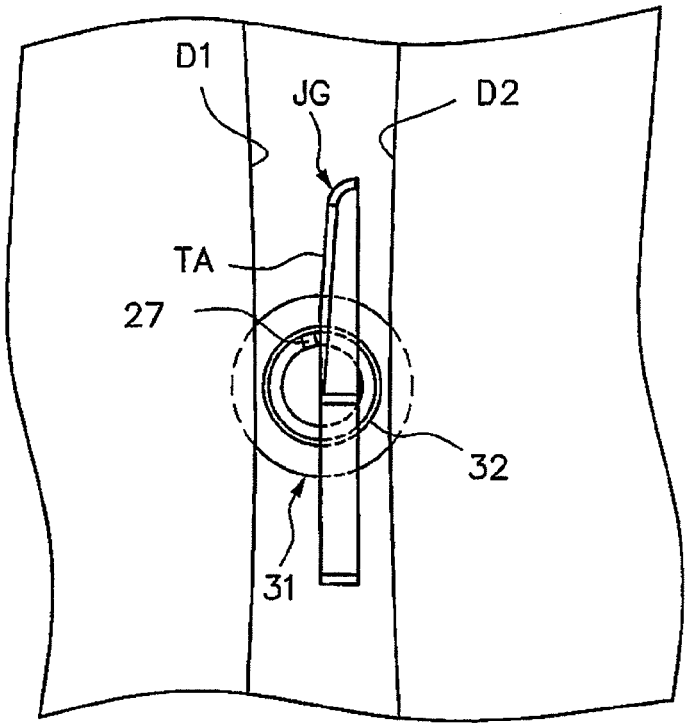

In the positioning step, as shown in FIGS. 8A and 8B, the positioning operation of the ground electrode 27 is performed in a circumferential direction in such a manner that the positioning jig JG is moved to the ground electrode 27 by making the side surface of the ground electrode 27 contact the tapered surface TA while the seat portion 33 is pressed against the rolling dies D1 and D2. At this time, the movement distance of the positioning jig JG is set to be uniform, and then the ground electrode 27 is disposed at the constant position in the circumferential direction at all times when the positioning jig JG is stopped. Further, at least a part of the tapered surface TA of the positioning jig JG is adapted to contact between the base end portion and the center portion in the length direction of the ground electrode 27. In the embodiment, it is set so that the positioning jig JG is stopped while the ground electrode 27 contacts the tapered surface TA, in other words, the positioning jig JG is stopped before a plane portion connected to the tapered surface TA and spaced from the ground electrode 27 contacts the ground electrode 27.

Figure 9:
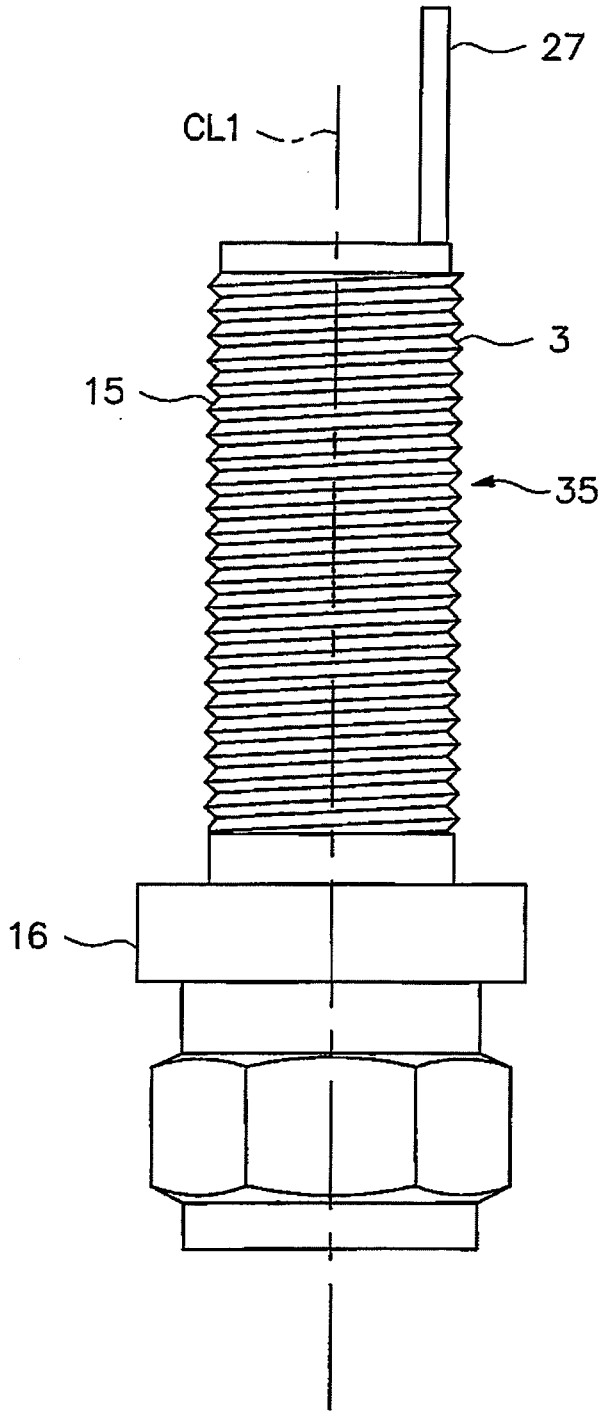
FIG. 9 is a plan view illustrating a configuration of a spark plug metal shell assembly.

After the positioning operation of the ground electrode 27 is completed, the positioning jig JG moves backward, and moves away from the ground electrode 27. Then, in the rolling step, the rolling dies D1 and D2 are moved close to the intermediate assembly 31 so that the processed portion 32 thereof is interposed between the rolling dies D1 and D2. Then, a rolling process is performed on the intermediate assembly 31 by rotating the rolling dies D1 and D2 while the seat portion 33 contacts the side surfaces of the rolling dies D1 and D2. Accordingly, the intermediate assembly 31 moves in the direction escaping from the rolling dies D1 and D2 (the direction toward the rear end side of the central axis CL1), and the screw portion 15 is formed in the processed portion 32, thereby obtaining a spark plug metal shell assembly 35 having the metal shell 3 and the ground electrode 27 as shown in FIG. 9.

Subsequently, the insulator 2 having the center electrode 5 and the terminal electrode 6 manufactured as described above is assembled to the spark plug metal shell assembly 35. More specifically, the insulator 2 is inserted from the base end side of the spark plug metal shell assembly 35 so as to be assembled thereto, and the rear end side opening portion of the comparatively thin spark plug metal shell assembly 35 is crimped inward in the radial direction, that is, the crimping portion 20 is formed, so that the insulator is fixed to the spark plug metal shell assembly. Finally, the ground electrode 27 is bent, and the size of the spark discharge gap 28 is adjusted, thereby obtaining the above-described spark plug 1.

As described above in detail, according to the embodiment, the intermediate assembly 31 is disposed between the rolling dies D1 and D2, the positioning operation of the ground electrode 27 is performed in the circumferential direction, and then the screw portion 15 is formed by the rolling dies D1 and D2. That is, the positioning operation of the ground electrode 27 is performed immediately before the rolling process, and the screw portion 15 begins to be formed while the position of the ground electrode 27 is adjusted with high accuracy in the circumferential direction. For this reason, the thread ridge of the screw portion 15 may be formed at a constant position with high accuracy with respect to the ground electrode 27.

Further, the positioning operation of the ground electrode 27 is performed while the front end side surface of the seat portion 33 of the intermediate assembly 31 is pressed against the rolling dies D1 and D2. Accordingly, the positioning operation of the ground electrode 27 may be very easily performed in consideration of the thread-insertion length of the screw portion 15. As a result, the thread ridge of the screw portion 15 may be more accurately formed at a constant position of the ground electrode 27.

Since the positioning operation of the ground electrode 27 is performed while the seat portion 33 is pressed against the rolling dies D1 and D2, a problem in which the ground electrode 27 moves too much during the positioning operation does not easily arise. Accordingly, the positioning operation of the ground electrode 27 may be more accurately performed in the circumferential direction, and hence the thread ridge of the screw portion 15 may be more reliably formed at a constant position.

Particularly, in the embodiment, since at least a part of the surface located at the halfway point of the inner peripheral side in the front end side surface of the seat portion 33 contacts the rolling dies D1 and D2, the front end side surface of the seat portion 33 may be pressed against the rolling dies D1 and D2 in a more reliable state. For this reason, the above-described effect may be more reliably exhibited since the positioning operation of the ground electrode 27 is performed while the seat portion 33 is pressed against the rolling dies D1 and D2.

Further, in the embodiment, the ground electrode 27 may be located at a constant position in the circumferential direction at all times by moving the positioning jig JG by a predetermined distance. The positioning jig JG may be adapted to be movable in a reciprocating manner, and a comparatively simple mechanism may be used as the movement means MO as a driving means of the positioning jig JG. This prevents the manufacturing facility from becoming complicated.

In addition, in the positioning jig JG, the curved surface portions R1 and R2 are formed so as to be connected between the tapered surface TA and the first side surface SI1 and between the tapered surface TA and the second side surface SI2, and an angular portion is not formed in the edge portion of the tapered surface TA. Accordingly, damage to the ground electrode 27 with movement of the positioning jig JG may be more reliably prevented, and hence the yield rate may be improved.

Further, the curved surface portion R3 is formed in the front end portion of the positioning jig JG, and hence a problem in which the ground electrode 27 collides with the front end surface of the positioning jig JG during the positioning operation does not easily arise. For this reason, the damage or the deformation of the ground electrode 27 may be more reliably prevented, and hence the yield rate may be further improved.

Furthermore, at least a part of the tapered surface TA of the positioning jig JG is adapted to contact the ground electrode between the center portion and the base end portion of the ground electrode 27 in the length direction (in other words, the root side of the ground electrode 27). Accordingly, as in the embodiment, even when the ground electrode 27 is formed in an elongated thin shape, in which case there may be more concern for deformation of the ground electrode 27 during the positioning operation, deformation of the ground electrode 27 may be more reliably prevented.

In the embodiment, the positioning jig JG is adapted to be stopped while the ground electrode 27 contacts the tapered surface TA, and when the positioning jig JG moves backward, the plane portion connected to the tapered surface TA and located at the side moving away from the ground electrode 27 may not be moved due to the friction with respect to the ground electrode 27. Accordingly, damage to the ground electrode 27 may be more reliably prevented.

Figure 10:
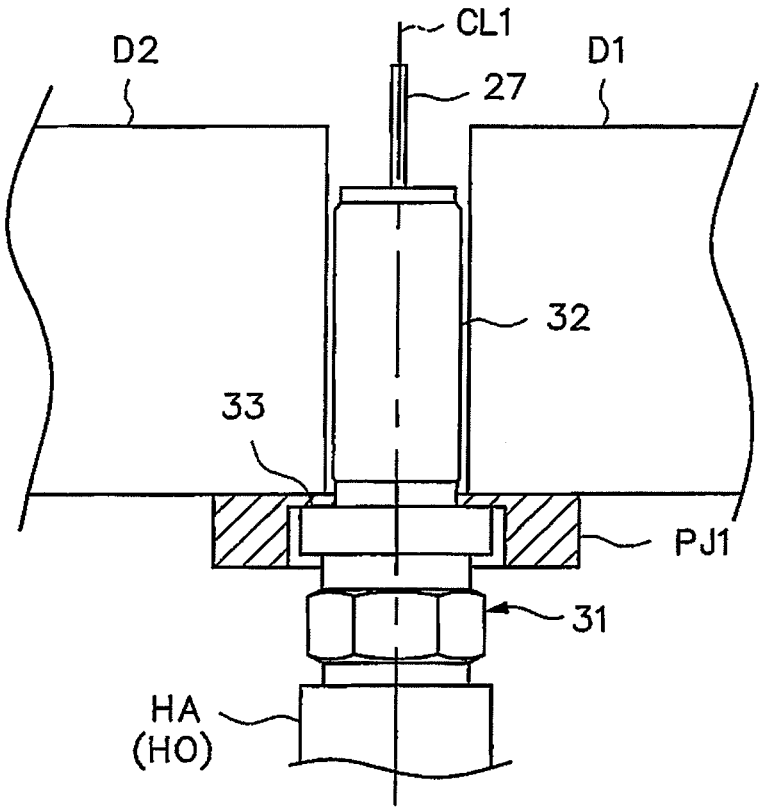
FIG. 10 is a partially cutaway enlarged plan view illustrating a pressing jig and the like of another embodiment.

It should be apparent to those skilled in the art that various changes in form and detail of the invention as shown and described above may be made. It is intended that such changes be included within the spirit and scope of the claims appended hereto. For example:

(a) In the above-described embodiment, in the positioning step, the positioning operation of the ground electrode 27 is performed in the circumferential direction while the seat portion 33 is pressed against the side surfaces of the rolling dies D1 and D2. However, as shown in FIG. 10, the positioning operation of the ground electrode 27 may be performed in the circumferential direction while the seat portion 33 is pressed against a cylindrical pressing jig PJ1 disposed between the intermediate assembly 31 and the rolling dies D1 and D2. In this case, the distance between each of the rolling dies D1 and D2 and the seat portion 33 may be changed by changing the thickness (height) of the pressing jig PJ1, and the relative positional relationship between the screw portion 15 and the ground electrode 27 may be variously changed. That is, the relative positional relationship between the ground electrode 27 and the screw portion 15 may be easily adjusted simply by providing the pressing jig PJ1 without changing the target disposition position of the ground electrode 27 in the positioning step or the configuration of the rolling dies D1 and D2.

Figure 11:
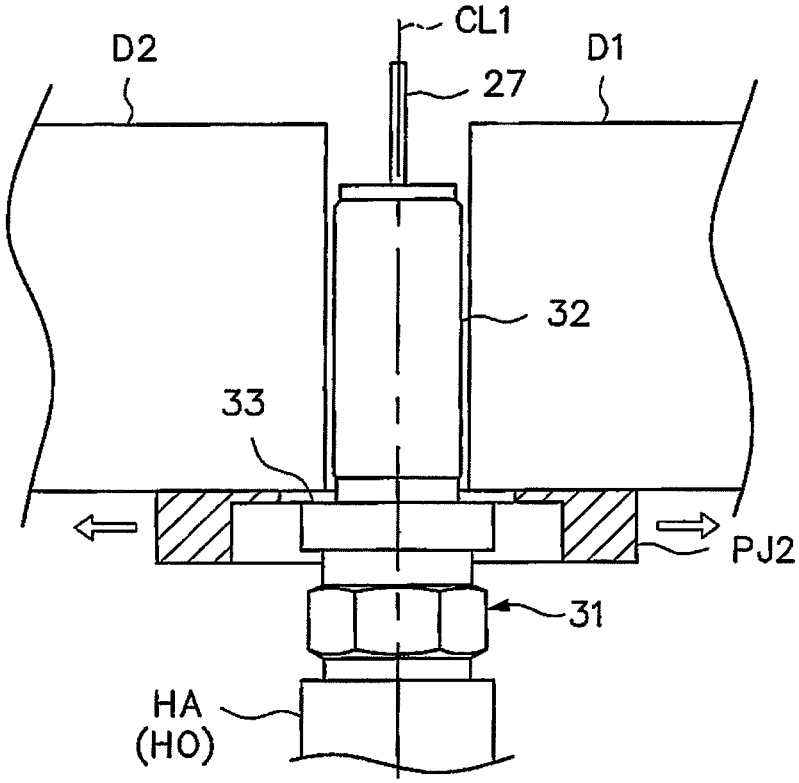
FIG. 11 is a partially cutaway enlarged plan view illustrating a pressing jig and the like of another embodiment.

Further, the rolling process may be performed while the pressing jig PJ1 is disposed. Alternatively, for example, when the pressing jig PJ2 is adapted to be separable as shown in FIG. 11, the pressing jig PJ2 may be separated after the positioning operation, and then the rolling process, may be performed. When the pressing jig PJ2 is separated, since a gap is formed between the seat portion 33 and each of the rolling dies D1 and D2, the rolling die that moves the intermediate assembly 31 toward the front end side of the direction of the central axis CL1 by the rolling process may be used as well as the rolling dies D1 and D2 that move the intermediate assembly 31 toward the rear end side of the direction of the central axis CL1 by the rolling process as in the above-described embodiment. Accordingly, the productivity may be further improved.

Figure 12A:
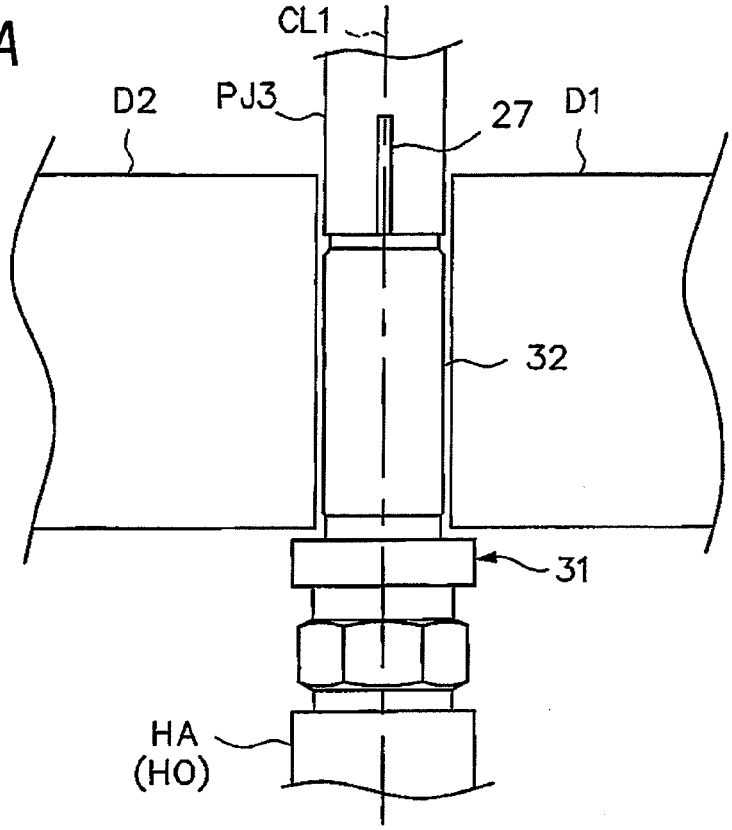
FIG. 12A and FIG. 12B are diagrams illustrating a pressing jig of another embodiment, where
Figure 12B:
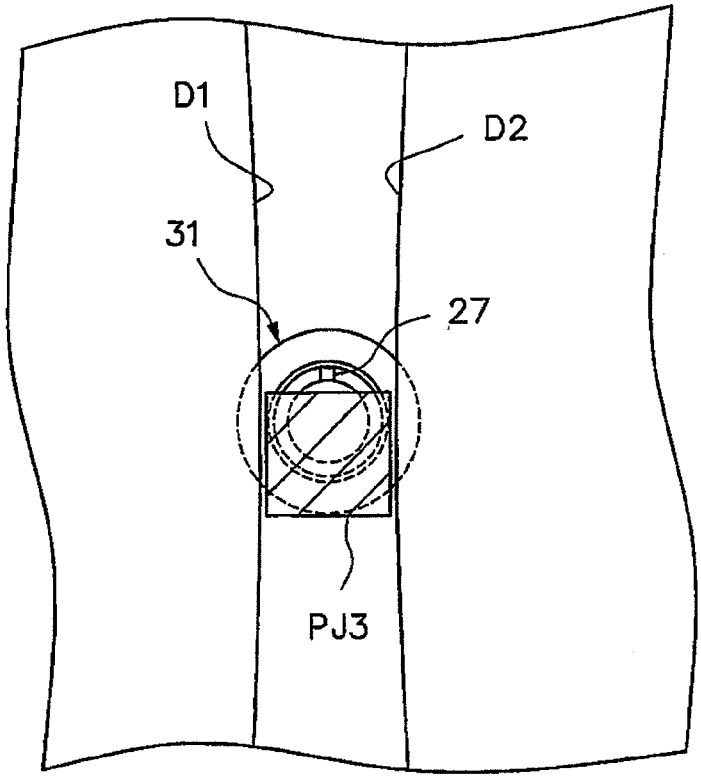

As shown in FIGS. 12A and 12B, in the positioning step, the positioning operation of the ground electrode 27 may be performed while the front end surface of the intermediate assembly 31 is pressed against a pressing jig PJ3 disposed between the rolling dies D1 and D2.

Figure 13A:
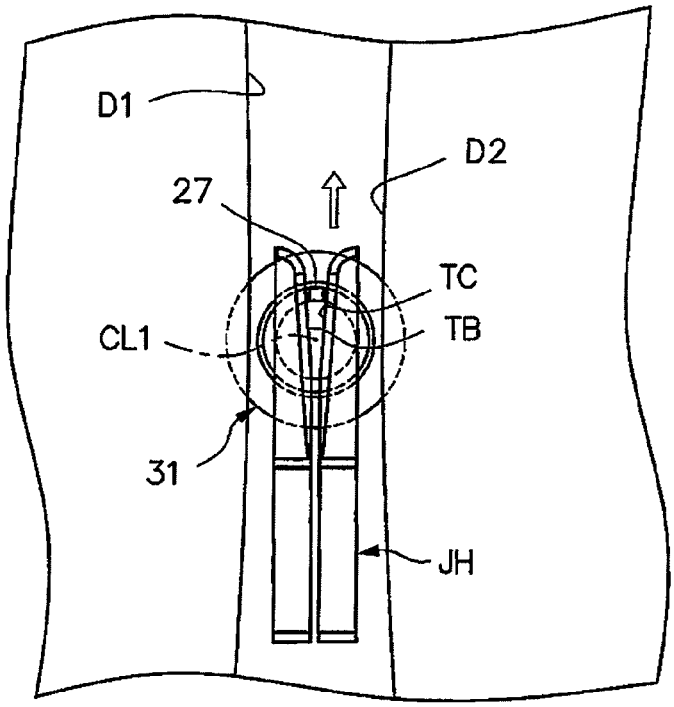
FIG. 13A and FIG. 13B are diagrams illustrating a configuration of a positioning jig of another embodiment, where
Figure 13B:
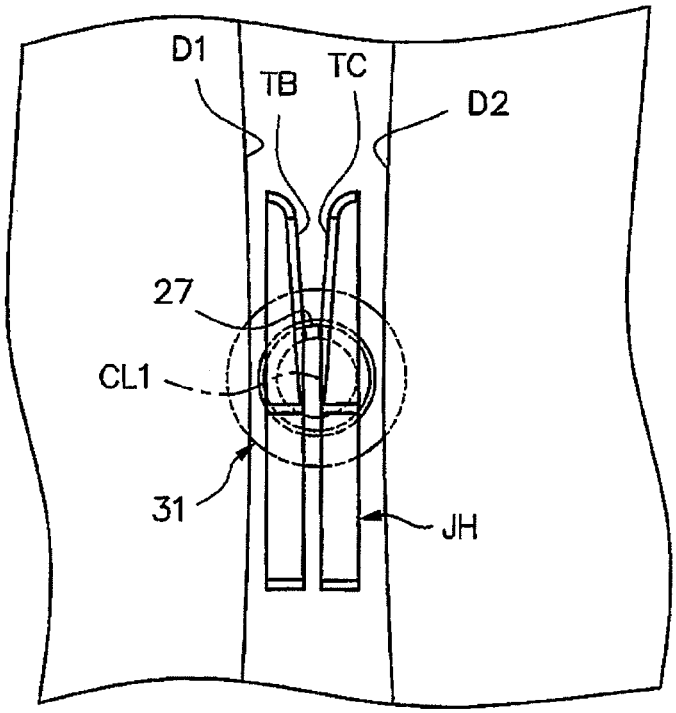

(b) In the above-described embodiment, the positioning operation of the ground electrode 27 is performed in the circumferential direction by moving the positioning jig JG, but the method of performing the positioning operation of the ground electrode 27 is not limited thereto. Accordingly, for example, as shown in FIGS. 13A and 13B, the positioning operation of the ground electrode 27 may be performed by moving a positioning jig JH having tapered surfaces TB and TC facing each other in the direction perpendicular to the central axis CL1.

Figure 14A:
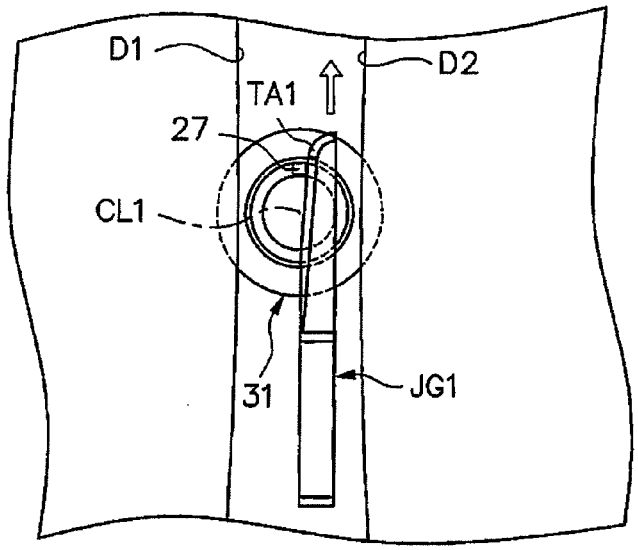
FIG. 14A, FIG. 14B and FIG. 14C are enlarged front views illustrating a configuration of a positioning jig of another embodiment.
Figure 14B:
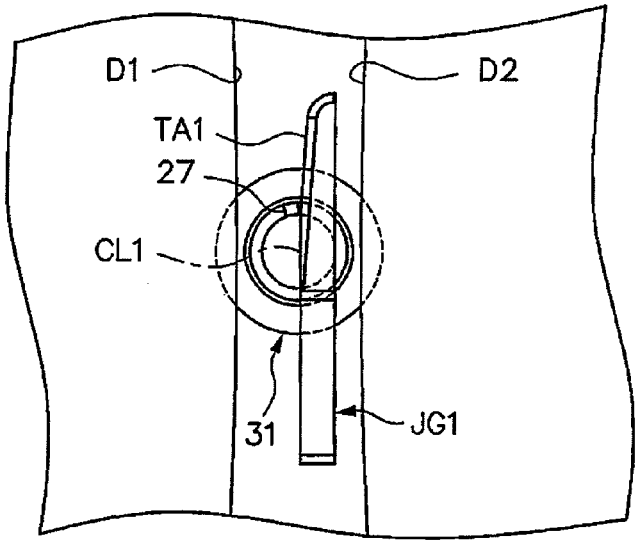
Figure 14C:
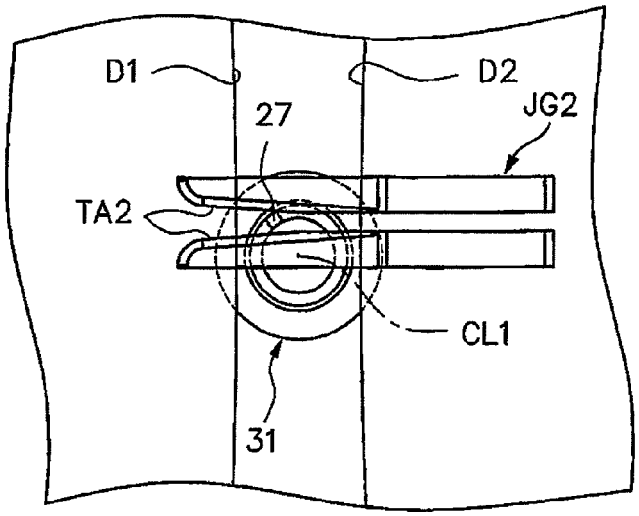

As shown in FIGS. 14A, 14B, and 14C, the positioning operation of the ground electrode 27 may be performed in the circumferential direction by using (1) a first positioning jig JG1 that is movable in the direction perpendicular to the central axis CL1 and has a first tapered surface TA1 inclined with respect to the movement direction and parallel to the central axis CL1, and (2) a second positioning jig JG2 that is movable in the direction perpendicular to the central axis CL1. Further, the movement direction of the first positioning jig JG1 and has a second tapered surface TA2 inclined with respect to the movement direction and parallel to the central axis CL1. Specifically, the position of the ground electrode 27 is adjusted to a certain degree by moving the first positioning jig JG1 toward the ground electrode 27 while the ground electrode 27 contacts the first tapered surface TA1. Then, the position of the ground electrode 27 may be more accurately adjusted in the circumferential direction by moving the second positioning jig JG2 toward the ground electrode 27 while the ground electrode 27 contacts the second tapered surface TA2. In this case, the positioning operation of the ground electrode 27 may be more accurately performed in the circumferential direction.

Figure 15A:
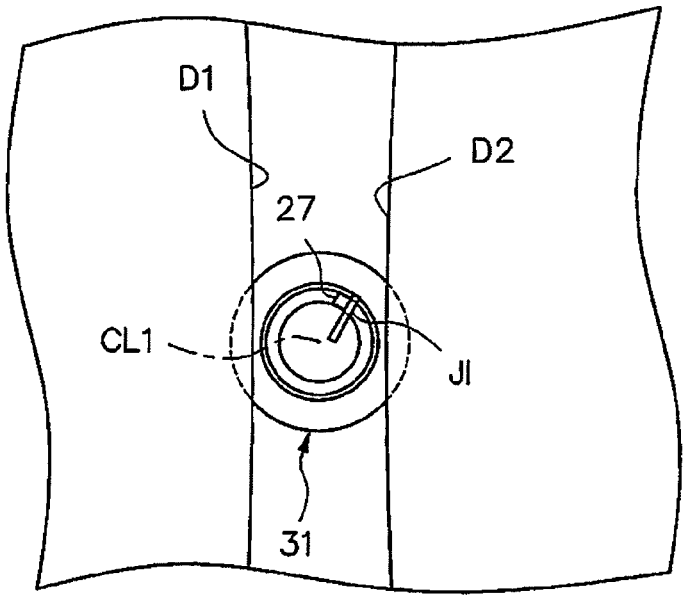
FIG. 15A and FIG. 15B are enlarged front views illustrating a configuration of a positioning jig of another embodiment.
Figure 15B:
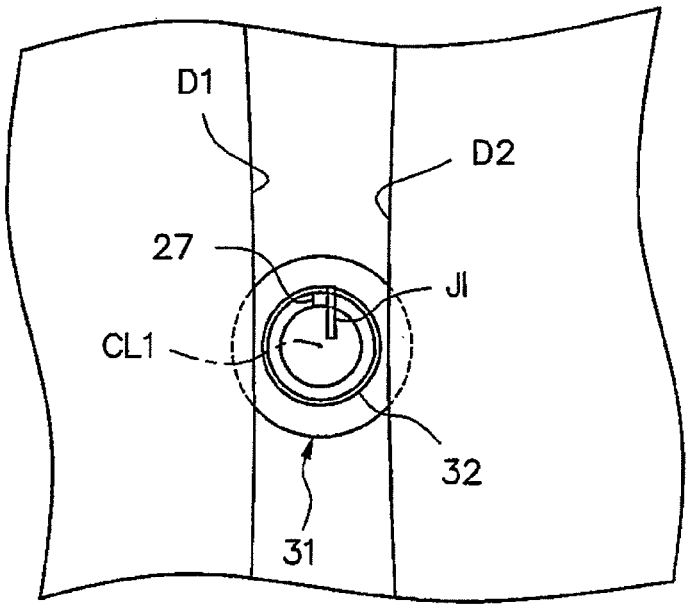
Figure 16:
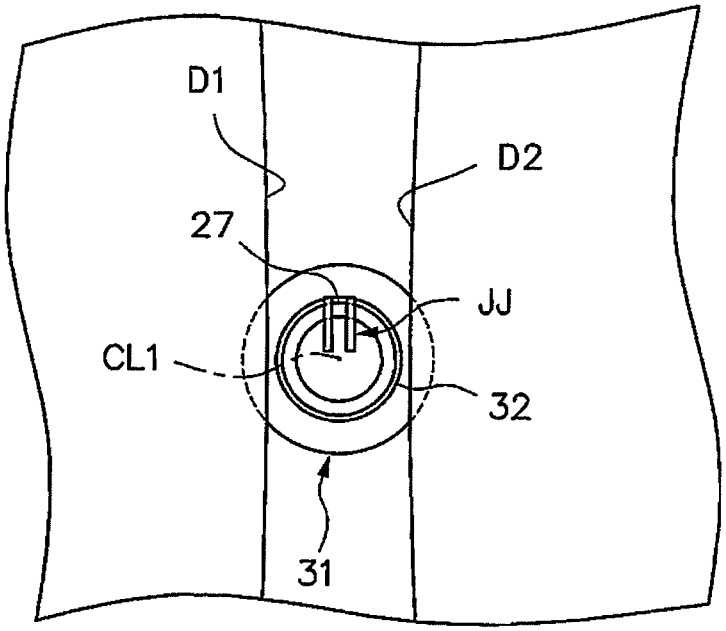
FIG. 16 is an enlarged front view illustrating a configuration of a positioning jig of another embodiment.

As shown in FIGS. 15A and 15B, the positioning operation of the ground electrode 27 may be performed in the circumferential direction by using a positioning jig JI that is rotatable about the central axis CL1. Further, as shown in FIG. 16, the positioning operation of the ground electrode 27 may be performed in the circumferential direction by using a positioning jig JJ that is rotatable about the central axis CL1 and is adapted to grip the ground electrode 27. In this case, a step of adjusting the position of the ground electrode 27 to a certain degree before the positioning step may be omitted. Further, since the ground electrode 27 may be gripped, the positioning operation of the ground electrode 27 may be more accurately performed.

Figure 17A:
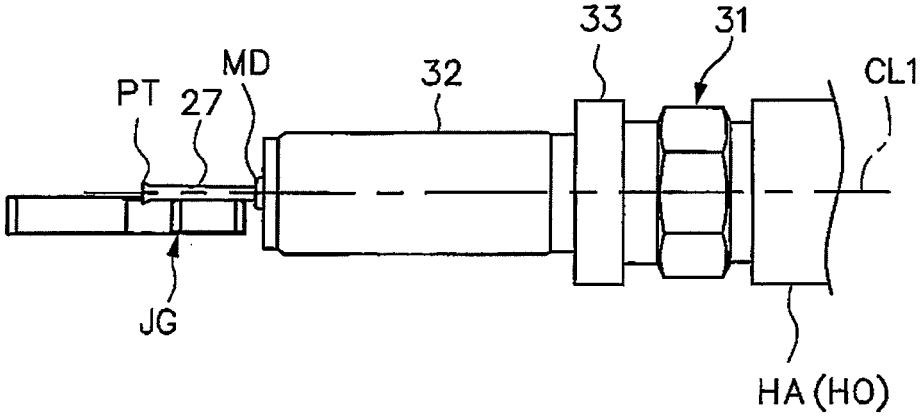
FIG. 17A and FIG. 17B are diagrams illustrating a portion contacting a positioning jig in a ground electrode of another embodiment, where
Figure 17B:
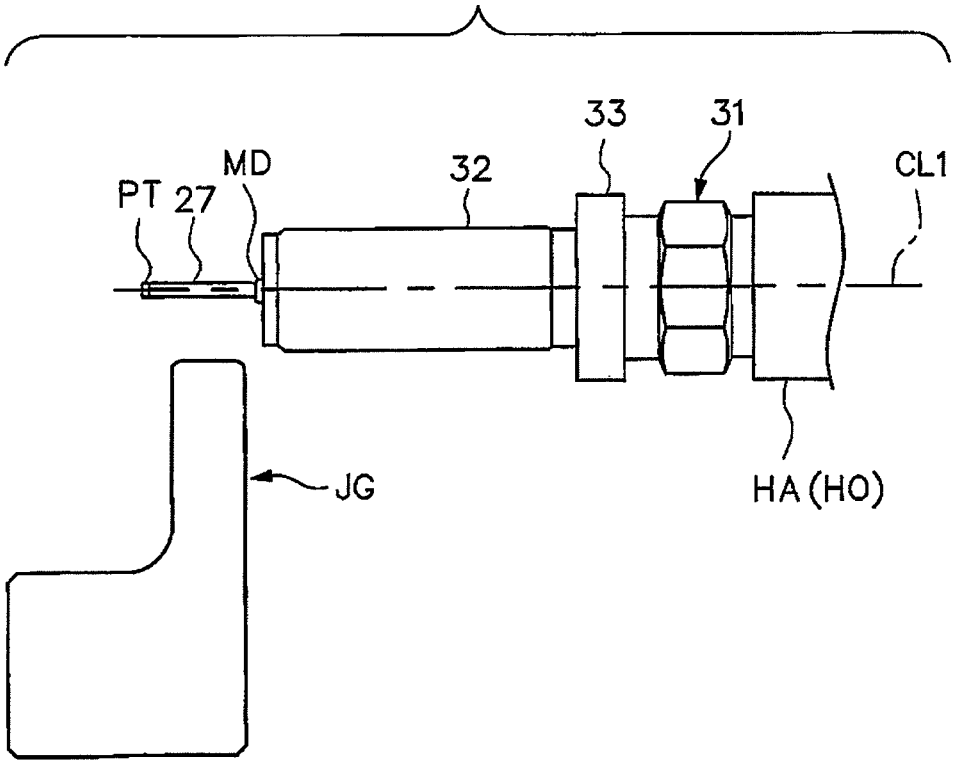

(c) In the above-described embodiment, although it is not particularly described, the direct bar-shaped ground electrode 27 may be manufactured by shear-cutting a rod-shaped member formed of an Ni alloy. In this case, as shown in FIGS. 17A and 17B (in FIG. 17, the rolling dies D1 and D2 and the like are not shown), a wide width portion (burr) PT may be formed at the end portion of the ground electrode 27 so as to be widened in the width direction. Further, a fusion portion (sagging) MD generated when welding the ground electrode 27 to the metal shell intermediate body 30 may be removed after performing a rolling process of the screw portion 15. In other words, the screw portion 15 may be formed while the fusion portion (sagging) MD remains. In view of this point, the positioning operation of the ground electrode 27 may be performed by causing the positioning jig JG to contact a portion of the ground electrode 27 between a portion spaced by 1 mm from the front end side of the ground electrode 27 toward the base end side and a portion spaced by 1 mm from the base end side to the front end side. In this case, since it is difficult for the positioning jig JG to contact the wide width portion PT or the fusion portion MD, the positioning operation of the ground electrode 27 may be more accurately performed.

(d) In the above-described embodiment, in the disposition step, the intermediate assembly 31 is disposed between the rolling dies D1 and D2 while the ground electrode 27 is adjusted to be located within the range of 15° in the left and right directions about the line L1 extending upward in the direction perpendicular to the central axis CL1 by a predetermined positioning unit. However, the position of the ground electrode 27 in the circumferential direction when the intermediate assembly 31 is disposed between the rolling dies D1 and D2 is not limited thereto. Accordingly, for example, in the disposition step, the intermediate assembly 31 may be disposed between the rolling dies D1 and D2 without particularly adjusting the position of the ground electrode 27. However, in this case, the target disposition position of the ground electrode 27 in the disposition step or the configuration (for example, the dimension or the like of the tapered surface TA) of the positioning jig JG needs to be changed.

Figure 18A:
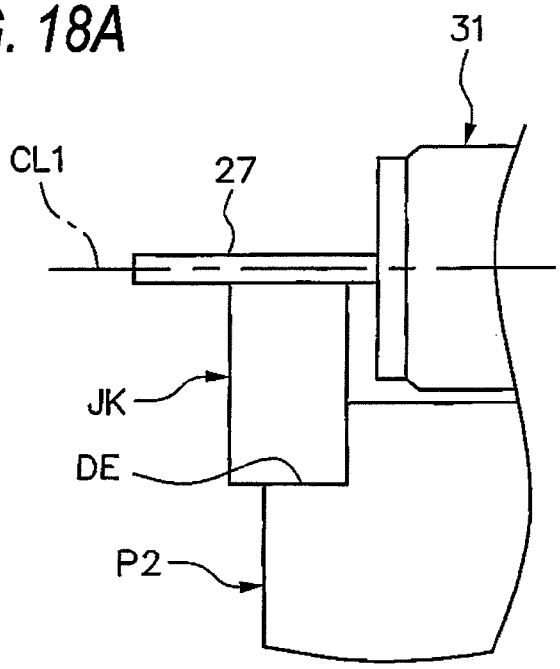
FIG. 18A and FIG. 18B are diagrams illustrating a configuration of a rolling die or a positioning jig of another embodiment, where
Figure 18B:
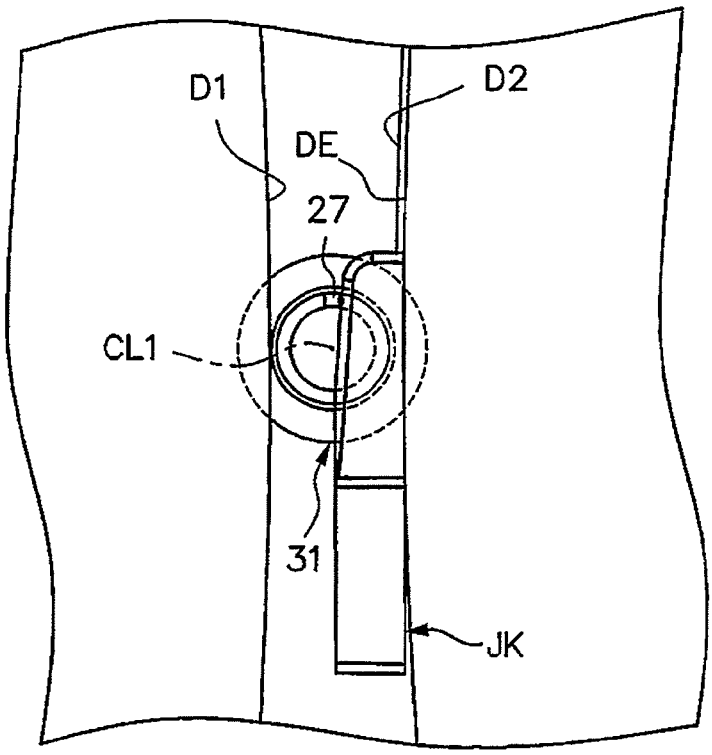

(e) In the above-described embodiment, although it is not particularly described, as shown in FIGS. 18A and 18B, a concave portion DE may be formed between the side surface and the process surface of the rolling die D2, and a positioning jig JK may be moved while coming into contact with the concave portion DE. In this case, since the positioning jig JK is held by the rolling die D2, bending or the like of the positioning jig JK may be suppressed. As a result, the positioning operation of the ground electrode 27 may be more accurately performed.

(f) In the above-described embodiment, the curved surface portion R3 is formed in the front end surface of the positioning jig JG, but the front end surface may be formed in a tapered shape.

(g) The screw diameter of the screw portion 15 or the size of the ground electrode 27 of the embodiment is merely an example, and the invention is not limited with respect to the screw diameter of the screw portion 15 or the size of the ground electrode 27.

(h) In the above-described embodiment, a case has been described in which the ground electrode 27 is bonded to the front end portion 26 of the metal shell 3. However, the invention may be applied to a case in which the ground electrode is formed by cutting a part (or a part of the front end fitting welded to the metal shell in advance) of the metal shell (for example, JP-A-2006-236906 and the like).

(i) In the above-described embodiment, the tool engagement portion 19 is formed to have a hexagonal cross-section, but the shape of the tool engagement portion 23 is not limited thereto. For example, the tool engagement portion may be formed in a Bi-HEX (dodecagonal) shape (ISO22977=2005 (E)) or the like.

This application claims priority from Japanese Patent Application No. 2010-016520, which was filed on Jan. 28, 2010, the disclosure of which is herein incorporated by reference in its entirety.

What is claimed is:

1. A method of manufacturing a metal shell assembly for spark plug including a cylindrical metal shell that extends in a direction of a central axis and which has a screw portion formed in an outer peripheral surface thereof for threading into an attachment hole of a combustion device, and a bar-shaped ground electrode that extends from a front end portion of the metal shell, the method comprising: disposing an intermediate assembly, having the ground electrode provided in a metal shell intermediate body to be used as the metal shell, between a plurality of rolling dies having process surfaces facing each other; forming the screw portion by performing a rolling process on the intermediate assembly by the plurality of rolling dies while the intermediate assembly is interposed between the plurality of rolling dies; and positioning the ground electrode in a circumferential direction about a central axis of the intermediate assembly between the disposing and forming steps, wherein the positioning is performed after the disposing and before the forming steps.

2. The method according to claim 1, wherein the intermediate assembly includes a seat portion that protrudes outward in a radial direction and has a front end side surface directly or indirectly contacting the combustion device when the screw portion is threaded into the attachment hole of the combustion device, and said positioning the ground electrode is performed while the front end side surface of the seat portion is pressed against the plurality of rolling dies.

3. The method according to claim 2, wherein in positioning the ground electrode, at least a part of a surface located at a halfway point of an inner peripheral side of the front end side surface of the seat portion contacts the plurality of rolling dies.

4. The method according to claim 1, wherein the intermediate assembly includes a seat portion that protrudes outward in a radial direction and has a front end side surface directly or indirectly contacting the combustion device when the screw portion is threaded into the attachment hole of the combustion device, and wherein said positioning the ground electrode is performed while the front end side surface of the seat portion is pressed against a pressing jig disposed between the seat portion and the plurality of rolling dies.

5. The method according to claim 4, wherein in positioning the ground electrode, at least a part of a surface located at a halfway point of an inner peripheral side of the front end side surface of the seat portion contacts the pressing jig.

6. The method according to claim 4, wherein the pressing jig is removed between the positioning and forming steps, and wherein in forming the screw portion, the rolling process is performed while the front end side surface of the seat portion is spaced from the rolling dies.

7. The method according to claim 1, wherein said positioning the ground electrode is performed while the front end surface of the intermediate assembly is pressed against a pressing jig disposed between the plurality of rolling dies.

8. The method according to claim 1, wherein in positioning the ground electrode, a first positioning jig is used which is movable in the direction perpendicular to the central axis and has a tapered surface inclined with respect to the movement direction and parallel to the direction of the central axis, and positioning the ground electrode is performed by moving the positioning jig while the ground electrode contacts the tapered surface.

9. The method according to claim 8, wherein at least first and second positioning jigs are used in positioning the ground electrode, such that the second positioning jig is movable in a direction perpendicular to the movement direction of the first positioning jig and the central axis, and wherein said positioning the ground electrode is performed by moving the first positioning jig while the ground electrode contacts the tapered surface of the first positioning jig and moving the second positioning jig while the ground electrode contacts the tapered surface of the second positioning jig.

10. The method according to claim 8, wherein the positioning jig includes a first side surface that is located at the intermediate assembly side in the positioning of the ground electrode and a second side surface that is located at an opposing side to the first side surface, and wherein the tapered surface is connected to both the first side surface and the second side surface by curved surface portions that are formed in a curved surface shape and protrude outward.

11. The method according to claim 8, wherein the positioning jig includes a portion that is formed in a curved surface shape protruding outward or a tapered shape inclining from a movement front end surface toward the tapered surface when the positioning jig is moved toward the ground electrode.

12. The method according to claim 8, wherein in positioning the ground electrode, the positioning jig contacts a portion between a portion spaced from the front end side of the ground electrode toward the base end side thereof by 1 mm and a portion spaced from the base end side thereof toward the front end side thereof by 1 mm.

13. The method according to claim 8, wherein in positioning the ground electrode, at least a part of the tapered surface of the positioning jig contacts a portion between the center portion of the ground electrode and the base end portion thereof in the longitudinal direction.

14. The method according to claim 1, wherein a positioning jig rotatable about the central axis is used in positioning the ground electrode, and said positioning the ground electrode is performed by rotating the positioning jig while the ground electrode contacts the positioning jig.

15. The method according to claim 14, wherein the positioning jig is adapted to grip the ground electrode, and said positioning the ground electrode is performed while the ground electrode is gripped by the positioning jig.

16. A method of manufacturing a spark plug, the method comprising:

assembling an insulator having a center electrode and a terminal electrode assembled thereto to the metal shell assembly manufactured by the method according to claim 1 from the base end side thereof; and allowing the front end portion of the ground electrode to face the center electrode.

17. A method of manufacturing a spark plug which comprises a metal shell assembly including a cylindrical metal shell that extends in a direction of a central axis and which has a screw portion formed in an outer peripheral surface thereof for threading into an attachment hole of a combustion device, and a bar-shaped ground electrode that extends from a front end portion of the metal shell, the method comprising: disposing an intermediate assembly, having the ground electrode provided in a metal shell intermediate body to be used as the metal shell, between a plurality of rolling dies having process surfaces facing each other; forming the screw portion by performing a rolling process on the intermediate assembly by the plurality of rolling dies while the intermediate assembly is interposed between the plurality of rolling dies; positioning the ground electrode in a circumferential direction about a central axis of the intermediate assembly between the disposing and forming steps; assembling an insulator having a center electrode and a terminal electrode assembled thereto to the metal shell assembly from the base end side thereof; and allowing the front end portion of the ground electrode to face the center electrode, wherein the positioning is performed after the disposing and before the forming steps.

* * * * *